United States Patent [19]

Rhodes

[11] 3,958,322

[45] May 25, 1976

[54] METHOD OF CASTING AN ALLOY HAVING THE APPEARANCE OF GOLD

[76] Inventor: William A. Rhodes, 4421 N. 13th Place, Phoenix, Ariz. 85014

[22] Filed: June 19, 1975

[21] Appl. No.: 588,201

Related U.S. Application Data

[62] Division of Ser. No. 477,620, June 10, 1974.

[52] U.S. Cl. ..... 29/527.6; 164/34

[51] Int. Cl.[2] ..... B22C 9/04

[58] Field of Search ..... 164/34, 35, 36; 29/527.6

[56] References Cited

UNITED STATES PATENTS 3,769,006 10/1973 Ingersoll ..... 164/34 X

*Primary Examiner*—J. M. Meister

[57] ABSTRACT

Method of casting an alloy comprising copper, aluminum and indium utilizing lost wax process. After the wax process. After the wax is melted from an investment mold the mold temperature is normalized at 250°F by placement in an autoclave. Thereafter the alloy is centrifugally cast at 2,000°F while the mold is at 250°F.

4 Claims, No Drawings

METHOD OF CASTING AN ALLOY HAVING THE APPEARANCE OF GOLD

This is a division of application Ser. No. 477,620, filed June 10, 1974.

BACKGROUND OF THE INVENTION

Utilization of aluminum bronzes as a gold substitute has never become widespread in the jewelry industry or in related products because of the difficulties of casting such bronzes due to the tendency of such alloys to cast into a generally woody grain structure.

Surface treatment of such castings has previously comprised mechanical abrasion since such prior art alloys are generally immune to chemical pickling or processing fluids.

With such alloys it has been difficult to solder or fuse the various fixtures thereto.

Prior art methods utilizing such aluminum bronzes have resorted to the inclusion of varying amounts of iron, nickel, silicon, manganese, tin, zinc, tellurium, lead and other materials in these alloys in order to render them capable of being readily cast. Substantial success has been achieved with castings using some of these metals and such castings as applied to machinery, where wear resistence and good corosion resistence is desired.

However, the use of an aluminum bronze containing aluminum and copper with the other metals mentioned has been unsuccessful for use as a substitute of gold in jewelry, artifacts and high detailed castings due to inferior results relating to the color complexion which is caused by the presence of the various foregoing metals added to the aluminum and copper.

These metals tend to reduce the color and luster characteristics as compared to the alloys containing only copper and aluminum. However, as heretofore set forth, such alloys of copper and aluminum alone are practically impossible to control as a casting material because of the pitting and woody grain structure at the surface of such castings.

While the addition of these various metals aforementioned make casting possible and help to eliminate the woody grain structure, the resultant alloys no longer have the rich appearance of gold but rather a dull, whitish-yellow which soon develops a dark coating as with the common bronzes.

Utilizing the foregoing prior art alloys, dirty looking castings are generally produced and brazing or soldering anything thereto is difficult. Additionally, polishing and buffing is very unsatisfactory and, therefore, castings of such material when an attempt is made to substitute for gold leaves a great deal to be desired.

A common and well known prior art gold substitute has been Nurnberg gold, an alloy of 90% copper, 7.5% aluminum and 2.5% gold was invoked. This alloy was rendered relatively easy to cast by utilizing 2.5% gold; however, the usual salt tests on Nurnberg gold alloy was disappointing. This Nurnberg gold substitute produced a green-black coating within eight hours when subjected to a salt test.

Additionally, various articles of jewelry such as rings, and bracelets caused a green deposit on the skin of wearers which was highly undesirable.

Additionally, some of the foregoing aluminum bronzes containing lead or iron for example and containing some other of the foregoing mentioned materials would produce an alloy which could be used to make dark marks on paper and consequently articles made of such alloys tended to rub off even in a dry state on various articles adjacent thereto. Accordingly, costume jewelry and other devices made of such prior art alloys caused marking and discoloration of the skin as well as clothing or the like.

SUMMARY OF THE INVENTION

This invention relates to an alloy of aluminum, copper and indium copper having an aluminum content ranging from one to seven percent, an indium content of 0.1 to 0.5% and the remaining being copper, the preferred percentages being 4.5% to 7.5% of aluminum, 0.3% to 0.5% of indium and the remaining percentage being copper.

My invention also includes a technique for making and casting the foregoing alloy.

Additionally, the method for producing the alloy includes the use of phosphorus in the molten copper whereby the indium and the aluminum readily alloy with the copper with a minimum of oxidation and attendant problems. The alloy of the invention has many desirable characteristics of 14 to 18 carat gold particularly as the alloy relates to costume jewelry, belt buckles and other items which may be worn on a person's hands or clothing.

The alloy of the invention is very malleable and subject to various forming operations and it is also readily receptive to fusion of various articles thereto by means of conventional lead and tin alloy solders as well as other solders such as silver solder or conventional brazing alloys. The alloy of the invention is very resistant to corrosion under normal environmental conditions in which the alloy is in contact with human skin. Additionally, the alloy does not readily make dark marks on articles on which it is rubbed as for example, the alloy does not readily tend to make black marks on paper when rubbed there against and consequently articles such as belt buckles which are made of the alloy of the invention do not tend to make undesirable marks on clothing as for example. Additionally, the cost of the materials to produce an attractive gold substitute in accordance with the present invention are very reasonably priced and the alloy of the invention has an appearance which so resembles 14 to 18 carat gold that it is almost impossible to recognize as a substitute.

Accordingly, it is an object of the present invention to provide an alloy having nobility similar to 14 carat gold specifically with regard to the usual environmental conditions as may apply to the handling and wearing of the alloy on a person's hands and also with relation to general atmospheric conditions under which the alloy may be worn in the form of rings, bracelets, etc.

Another object of the invention is to provide an alloy having almost identical appearance to gold and which is comparable in tarnish resistence to 14 carat gold alloys when subjected to the usual salt corrosion tests.

Another object is to provide an alloy which is substantially unaffected by oxidizing conditions of a torch or furnace and which may be cast into open molds with no adverse affect on the surface color of the alloy.

Another object of the invention is to produce an alloy which has ductility equal to conventional 14 carat gold alloys.

Another object of the invention is to produce an alloy which is substantially equivalent to 14 carat gold or sterling silver in its ability to be sawed, ground, cast, tumbled, pickled, polished and which is also readily fusible with soft and hard solders with or without silver or gold therein.

Another object of this invention is to provide an alloy having tarnish resistence substantially equal to 14 carat gold when under the same time and wear conditions wherein the alloy of the invention does not tarnish to any darker or greater proportion than is evident in the gradual tarnish or darkening of 14 carat gold alloys.

A further object of the invention is that the alloy of the invention after soldering may be pickled and buffed and thereby readily removing any slight surface discoloration caused by heating and such being comparable to the effects on 14 carat gold alloys when soldering or other fusion processes are accomplished thereon which causes heating thereof and resultant slight change in color.

An additional object of the invention is to provide an alloy which contains the richest yellow color of the 14 to 18 carat gold alloys.

DESCRIPTION OF THE PREFERRED EMBODIMENTS

The alloy of the invention comprises aluminum and copper and these metals are of the highest purity. The alloy also comprises Indium of the highest purity and these three elements are included in the alloy in the following proportions: the aluminum ranges from 1 to 7.5%; however, the preferred range is 4.5% to 7.5% by weight. The Indium ranges preferably between 0.3% and 0.5% by weight of the alloy with the broadest range of the Indium being between 0.2% and 0.5%. Aluminum ranging between 4 and 10% in combination with copper at 93%, for example, will produce a color which is almost identical to that of 14 or 18 carat gold.

When the aluminum is present in the alloy in an amount of 7% a small oxide loss may be expected and this adjusts the total of aluminum in the alloy to a slightly lesser percentage, as for example, between 6.9 and 7%.

The addition of 7% of aluminum to the alloy is considered to be maximum since 7.5% aluminum may cause undesirable effects in the casting and working of the alloy if it includes more than this amount.

There is a substantial latitude in the aluminum range as for example between 4 and 7% and throughout this range the required color of the aluminum copper alloy remains constant and closely resembles 14 carat gold. Additionally the other characteristics which include malleability and other desirable factors disclosed herein remains substantially constant.

The indium in the foregoing percentages significantly contributes to hardening, strengthening and increasing the corosion resistence of the alloy of the invention.

It has been found that less than 0.2% indium in the alloy causes it to return to the binary aluminum bronze characteristics while the indium content at 0.5% affords all the foregoing characteristics set forth in the summary and objects of the invention.

0.5% Indium in the alloy causes a very slight darkening of the yellow color and beyond that amount there is a sudden decrease of yellow toward lighter color than the original aluminum copper binary alloy.

Whitening of the alloy is evident at about 1% while 0.5% indium appears to be optimum for color and other desirable characteristics of the alloy and 0.3% is the minimum for the achievement of the color and other characteristics hereinbefore set forth.

The alloy including 0.5% indium is relatively easy to pickle in dichromate sulfuric acid solution in a few seconds whereas a binary alloy of copper and aluminum without the indium is very difficult to pickle and clean.

The indium also contributes to the brilliant luster and the ease with which the alloy may be buffed and polished. Also indium contributes to the character of the alloy rendering it readily fusible with tin lead solders or low silver and gold solders.

The addition of the indium to the copper and aluminum causes the alloy of the invention to resemble 14 carat gold alloys in almost all noble characteristics except density and attack by strong nitric acid.

The alloy of the invention does yield to ammoniums and hydroxides at substantially the same rate as 14 carat gold alloys containing copper.

It is to be noted that the copper content of the alloy is approximately 93% more or less by weight of the alloy and the alloy may be produced as follows: this pure copper may be melted by either a reducing neutral or oxidizing flame. The neutral and oxidizing flame produces an excellent malleable casting while a reducing or carbonizing flame produces a much harder metal and is liable to likewise cause bubbles deep within the casting.

The copper is first melted then 0.5% of indium is introduced into the molten copper then phosphorus ranging from 0.05% down to 0.025% is added as a P-rich copper for the purpose of deoxidizing the molten copper and indium. Within a few seconds after the phosphorus is added the aluminum in the foregoing percentage of approximately 7% is added in the form of a rod or wire which is immediately pushed into the molten surface of the copper and indium.

Addition of the aluminum is immediate and an exothermia is evident. Thus the exothermal reaction causes a rise in temperature of the melt and this temperature rise may be as much as 300° Fahrenheit. The aluminum rod should be gradually pushed into the molten mass until it is completely melted and almost instantly an aluminum skin flashes over the surface of the entire melt rendering the molten alloy immune from further oxygenation. During the insertion of the aluminum in rod form care should be taken to feed the rod into the surface only as it melts and to avoid pushing the aluminum against the bottom of the crucible in which the melt is contained.

Mechanical stirring is avoided in order to prevent the possibility of gas entrainment and also to prevent the oxygenation of aluminum in the alloy.

After the alloy is poured from the crucible, a thin coat of aluminum will sometimes be seen on the crucible bottom. However, this amount of aluminum is very small and even at times if the aluminum content is reduced to a percentage ranging between 5 and 6% the aluminum content is within the optimum range and accordingly, the characteristics of the alloy are maintained as aforementioned.

The least amount of stirring during the production of the alloy as aforementioned is desirable; however, any stirring should be accomplished by a carbon rod, the only material which should be used, and the carbon rod is preferably inserted into the molten alloy and stirred only with the rod in place without any in and out movement of the rod while moving very slowly. The rod should then be pulled straight out of the melt and after such limited stirring the melt can be kept heated for any length of time or poured into ingots.

The alloy is preferably poured into ingots and reheated before casting due to the fact that complete alloying apparently takes place when the alloy is remelted and this is the preferred method of producing the alloy and then remelting it for preparing castings.

The melting temperature is approximately 1950 degrees Fahrenheit and the preferred casting temperature is approximately 2000 degrees Fahrenheit. It will be noticed that an aluminum skin is evident on the top of the cast also an aluminum skin may be present in the bottom of the crucible. During initial casting of ingots or during remelting of the alloy after ingots have been produced it may be noted that an oxide scum is present on the surface of the melt and it may be necessary to move the scum back slightly from the pouring spout of the crucible outlet area when centrifigal casting of the alloy is being accomplished.

It should be noted that continueous raking of the skin off the melt should be avoided so as to avoid undue lowering of the aluminum content of the alloy.

For ideal melting conditions an induction furnace should be used which causes the alloy to stir itself adequately due to electromagnetic action of the induction field.

Accordingly, it is recommended that the induction furnace be used during the alloying as well as the preparation of the alloy for casting; however, as aforementioned, a torch flame which is either neutral or oxidizing may be used effectively.

Inasmuch as the melting temperature of the alloy is approximately 1950° Fahrenheit and the casting temperature is ideally about 2000° Fahrenheit, an optical pyrometer must be used in order to determine the proper casting temperature of the metal when it is desired to make castings in the conventional investment lost wax process, for example.

An optical pyrometer used for this purpose will have limits of error plus or minus 50° from the 2000° temperature and it may be desirable to heat the metal of the alloy to a temperature ranging in the region of 50 to 100° Centigrade above the melting point of the metal; however, temperatures above this range should be avoided in order to minimize the tendency of the metal to become damaged due to gas entrainment as the pour takes place or during the casting of the metal from the crucible into a mold.

According to the method of the invention for casting the alloy of the invention in an investment casting mold the mold is first produced and placed in a furnace to burn out the wax from the mold. Conventional practice may be followed in producing investment casting molds and for burning the wax out and the temperature of the furnace should be gradually declined to a range between 700 to 800° Fahrenheit whereupon the mold should then be placed in an autoclave preheated to 250° Fahrenheit and the mold should be allowed to normalize at that temperature. In accordance with the method of the invention this autoclave step takes the panic out of split second timing usually attendant to the lost wax casting process; however, the real reason for this low investment temperature is to enable the operator to get a casting of such beauty from the alloy of the invention that little surface treatment will be needed.

The usual hot mold will only produce dirty oxidized surfaces on the castings and also the alloy containing a major amount of copper will also combine with the sulfur in the hot mold to form heavy oxides on the casting thus the invention comprises a novel step of autoclaving the mold to a relatively low temperature of 250° Fahrenheit to avoid a reaction of the copper in the alloy with the sulfur in the hot mold which has been prepared by the conventional lost wax process. When the alloy of the invention is cast in a mold thus prepared and at the low temperature of approximately 250° the part comes out of the mold very bright and clean and has a very attractive gold color.

When an investment casting mold at the foregoing temperature is placed in a conventional centrifugal casting machine such as used in the dental industry, the machine should be wound no more than 2.5 turns for casting the foregoing alloy of the invention.

The casting procedure for attaining a casting of the alloy in the lost wax process is as follows: after measuring out the amount of the alloy by weight which is desired, the optical pyrometer is energized and set in place; the alloy is melted without any fluxes due to the fact that fluxes are not needed with the alloy of the invention and oftentimes fluxes tend to obscure the operation of the optical pyrometer due to a smoky cloud through which you cannot obtain a pyrometer reading.

If using a flame, utilize an oxidizing or neutral flame to melt the alloy of the invention in a cricible and use a stainless steel blade or carbon only for the purpose of raking the scum from the surface and for the purpose of forcing separate pieces of the alloy to comingle as a single liquid.

It is desired practice to mount the optical pyrometer on a tripod in order to maintain steady use thereof and the optical pyrometer should be directed to the center of the molten mass in the crucible which is set in the centrifugal casting machine which has already been wound to approximately 2.5 turns. As temperatures increased and the alloy is heated the pyrometer optical filament appears suddenly darker than the molten mass, the heating is then continued and the scum on top of the molten mass is raked back and heating is continued until it is well above the pyrometer temperature setting. Leave the temperature setting at 2000° and do not stir the alloy. At this point while watching the pyrometer suddenly remove the flame and when the pyrometer filament center suddently vanishes into the same color as the background of the metal release the centrifuge. At this point the centrifuge will whirl and centrifugally force the molten metal from the crucible into the adjacent mold which is at approximately 250° Fahrenheit. While the skin on the molten mass tends to indicate a temperature higher than the actual temperature of the alloy this is compensated for at the 2000° reading while the actual temperature may be slightly lower than this since the skin temperature appears brighter than the actual metal underneath. Thus the 2000° observed temperature is correct for all small casting. While some variation may be expected if the alloy is to be used in different mold materials than the conventional lost wax molds hereinbefore referred to.

When the casting is removed from the mold it will have a bright clean appearance and this surface appearance is very slightly lighter in color than conventional 14 carat gold; however, it is very lustrous and beautiful and is believed to be lighter due to the aluminum oxide skin which is comparable to a conventional anodized surface. The castings are very attractive as they are removed from the mold and may be used in this condition; however, if it is desired to polish the castings the golden anodize must first be removed so as to reach the base metal.

This may be accomplished by tumbling the casting first in a tumbler with four pounds of number 2 tacks plus 600 milliliters of water and 1 teaspoon of trisodium phosphate. This process microscopically peens off the surface but adds a luster which enhances the surface of the casting. Following the tumbling the castings are pickled in a solution which comprises 2 oz. of potassium dichromate for each pint of tap water, and In a separate solution place one pint of water and pour 115 grams of sulfuric acid of approximately gravity 1270–1300. Both solutions are then mixed together and the casting is then dipped in the pickling solution for a few seconds as for example 30 seconds and the casting is then rinsed in water. It may be desirable to rub the casting with dry sodium bicarbonate dampened in water repeating with a rinse in water to finish the process.

If any discoloration remains on the casting the pickling process should be repeated with a rinse in water, bicarbonate solution, water and dry bicabonate rub down and rinse again will usually eliminate all the residues following the tumbling operation. It will be understood that the steel in the tacks which is used in the tumbler tend to leave iron on the surface of the castings and, therefore, the pickling process is necessary to remove the discoloration caused by the iron or steel tacks in the tumbling process.

It should be noted that when the casting is removed from the mold chemical treatment along tends to exhibit fine granular structure which can be buffed away but this requires considerable effort and is not generally recommended.

The alloy of the invention may be rolled into very thin sheets due to its highly desirable malleability and it may be necessary to progressively heat the material during various stages of rolling or when the material is being drawn into wire.

The alloy of the invention when heated by the usual soldering or fusion processes may turn color on the surface and this color may readily be removed by pickling in the hereintofore disclosed pickling solution whereby the previously described rinse may be used to remove the solution of the pickling bath.

When it is desired to fuse or solder to the alloy of the invention a good flux is recommended and the flux commonly known as Green Streak has been very satisfactory.

The alloy of the invention will also respond to toning baths and a 10 to 12 carat gold hue can be obtained by dipping the alloy of the invention into toluene saturated with flours of sulfur (sulfur dust) then laid in the open and allowed to dry. This produces an accelerated aging effect not obtainable with ordinary bronzes but after rubbing with a clean cloth much resembles 14 carat gold.

Heating of the alloy to the proper temperature will produce an irridescent hue of very tenacious quality.

It will be obvious to those skilled in the art that various modifications may be resorted to without departing from the spirit of the invention.

I claim:

1. A method of investment casting an alloy comprising aluminum, copper and Indium, wherein: an investment mold is placed in a furnace with a wax cavity forming part therein; heating the mold to burn the wax part therefrom and whereby forming a cavity in said mold; reducing the temperature of the furnace to a temperature ranging between 700° and 800° Fahrenheit, then removing the mold from the furnace at such temperature and placing the mold in an autoclave which has been preheated to approximately 250° Fahrenheit and allowing said mold to normalize at said temperature of 250° Fahrenheit, then heating said alloy to a molten temperature of approximately 2000° Fahrenheit; then centrifugally casting said alloy into said mold while said mold is at a temperature of approximately 250° Fahrenheit.

2. The invention as defined in claim 1, wherein: the mold is then cooled and the casting is removed from said mold; then tumbling said casting in an abrasive medium; then pickling said casting in acid to remove foreign matter from the surface of said casting.

3. The invention as defined in claim 2, wherein: said casting is then immersed in a base solution to neutralize and remove the pickling acid from said casting.

4. The invention as defined in claim 3, wherein: the casting is then buffed to produce a lustrous finish on the surface areas thereof.

* * * * *